United States Patent [19]

Woodring et al.

[11] 4,285,639

[45] Aug. 25, 1981

[54] ELECTRONIC CONTROL FOR VARIABLE DISPLACEMENT PUMPS

[75] Inventors: Richard H. Woodring, Plainwell; Paul K. Houtman, Kalamazoo; Thomas A. Kowalski, Paw Paw; Charles H. Whitmore, Plainwell, all of Mich.

[73] Assignee: Parker-Hannifin Corporation, Cleveland, Ohio

[21] Appl. No.: 47,853

[22] Filed: Jun. 12, 1979

[51] Int. Cl.[3] ..... B64C 11/04; B63H 5/00

[52] U.S. Cl. ..... 417/218; 417/280

[58] Field of Search ..... 417/218, 279, 280, 282, 417/26, 28; 60/52 VS, 462

[56] References Cited

U.S. PATENT DOCUMENTS

| | | | |
|---|---|---|---|
| 3,269,319 | 8/1966 | Dargas | 417/28 |
| 3,625,637 | 12/1971 | Kiwalle et al. | 417/218 |
| 3,777,492 | 12/1973 | Boydell et al. | 60/462 |

*Primary Examiner*—Leonard D. Christian
*Attorney, Agent, or Firm*—Joseph B. Balazs

[57] ABSTRACT

An electronic control system for pressure and flow control of variable displacement pumps consists of a closed loop system of operational amplifiers which provide continuous control of the volume modifying element in the pump. In a variable displacement vane pump application a command flow control signal and a feedback signal representative of the position of the adjustable cam ring in the pump are applied to an integrating amplifier to develop a signal for application to an electro-hydraulic valve in the pressure compensating portion of the pump. A command pressure signal is compared with the control signal to limit the latter to a level, thereby providing pressure control for the pump. Slip compensation is effected in the control system by utilizing a portion of the control signal to provide proportional modification of the command signal.

30 Claims, 4 Drawing Figures

ELECTRONIC CONTROL FOR VARIABLE DISPLACEMENT PUMPS

BACKGROUND OF THE INVENTION

This invention relates to variable volume pumps and more particularly to an electronic combined flow and pressure control system for such pumps.

Both pressure and flow controls are known for variable displacement pumps, typically being provided as options selectable for the particular application. Pressure compensation is the most common form of control but flow compensation also finds widespread use when it is desired for example, to control the rate of movement of an actuator device. It is known, as well, to combine both flow and pressure compensation in a common application and this is typically accommodated by the use of both substantially independent options on a common pump. In the interests of conservation of energy it has become more common to utilize the full flexibility afforded by the variable displacement pump including the advantage of common flow and pressure control.

It has also become more commonplace to include remote capability in such control systems not only to achieve the advantage of selecting or modifying operational characteristics of the pump from a distance, but more importantly to achieve the end of providing such control continuously and responsively as a function of an electrical signal. Such arrangement provides a high degree of capability and flexibility for the system.

In the past there has been the capability for remote selection of both flow and pressure compensation levels in variable displacement pumps, but as indicated, these have involved the use of substantially independent devices and the cost has been prohibitive in many applications. These devices essentially consist of independent closed loop position control systems for setting a mechanical element, either of the pump itself or in a control portion of the pump. Each system typically would consist of an error and power amplifier electronic section, responsive to an input command signal and a feedback signal derived from a transducer coupled to the controlled element and, typically, further, a servo valve for delivering fluid to a control piston.

Thus, for example, in the variable volume vane type pump shown in the Schink et al. U.S. Pat. No. 3,549,281, a closed loop position control system capable of positioning an output rod, might be coupled to the compensator portion of the Schink pump so that the output rod engages the end of the spring in the compensator control, to adjust the bias produced by the spring. This then provides remote pressure compensation for the pump.

Simultaneously therewith, a second closed loop position control system might have a position transducer mechanically coupled to the cam ring of the pump and be responsive to a command signal to provide fluid pressure, by means of a servo valve acting upon pump output fluid, into the control piston of the pump which effects positioning of the cam ring. This then provides remote flow control for the pump and together with the pressure control described, results in a combined capability.

In such prior art systems it is apparent, with the increased complexity of a full flow and pressure combination system, that reliability becomes a consideration due strictly to the number of components involved. Of much greater concern, however, is the cost of implementing such systems. The great versatility afforded by the variable displacement pump has brought it into the forefront recently as the device which can meet the need of energy conservation. However, in order for it to find widespread use, it is important that the controls associated with it, which provide it with its versatility, not be cost prohibitive.

SUMMARY OF THE INVENTION

This invention is a simplified control system for variable displacement pumps and the like and provides the capability for combined flow and pressure control for such pumps. The system is effected as an electronic system utilizing integrated circuit operational amplifier devices capable of acting upon electrical command signals of flow and pressure to provide such control in a variable displacement pump. A control is also provided for compensating for slip in the pump at various pressure levels and may be adjusted to provide different compensation as the pump and system components age.

In the preferred embodiment of the invention the system is applied for control of a variable displacement vane pump used in an injection molding machine for plastics. In such application it is desirable to provide a controlled closing rate for the molding dies and thereafter to provide a controlled force upon the closed dies during the injection molding operation. Such application is particularly suited to the variable displacement pump wherein initial flow control is provided to achieve the controlled closing rate of the die sections and thereafter pressure control provides the means for achieving the controlled clamping force of the dies. In this application it is also desirable during the flow controlled portion of the cycle to utilize, as well, the pressure control feature of the system to prevent an overload condition from occurring.

In the preferred embodiment of this invention a conventional variable displacement vane-type pump is utilized together with a fluid actuated compensator valve portion, the latter being regulated by an electrohydraulic valve of the proportional control variety, receiving signals from an electronic control system.

The compensator is in part a conventional spring biased spool valve unit receiving fluid pressure from the outlet of the variable displacement pump and providing a throttled level of fluid pressure to the control piston of the pump as a function of the outlet fluid pressure level. In a typical compensator device such fluid pressure acts upon the spool of the valve which is opposedly biased by a spring member. In prior art systems the bias of the spring was manually adjustable or was settable by means of a closed loop position control system. In this embodiment of the invention spring bias on the spool of the compensator valve is augmented by fluid pressure developed from the outlet of the vane pump under the control of an electrohydraulic servo valve. The servo valve is of the proportional control variety producing a fluid pressure output level proportional to the amplitude of an electrical signal applied at its input.

Such electrical signal is developed in a control system of integrated circuit operational amplifiers which receive electrical input signals of flow and pressure command levels together with a feedback signal indicative of the position of the cam ring in the vane pump.

An integrator stage in the control system receives the combined flow input command signal and the feedback signal from the cam ring position transducer and provides an output signal indicative of a desired position for the cam ring in the vane pump. This output signal is applied to a summing junction receiving the output of a second operational amplifier which in turn acts upon the combined signal of the output of the integrator amplifier and a command signal indicative of a maximum desired pressure level. The output of the second amplifier is applied by way of a logic circuit to the input of a third operational amplifier together with that signal from the output of the integrator amplifier. The logic circuit acts in a manner such that the output of the second operational amplifier limits the value of the signal applied to the third operational amplifier, this action providing the pressure limiting function. A resultant signal is then developed at the output of the third amplifier stage and applied to a power amplifier to develop a control signal for application to the electro-hydraulic valve. The valve then produces a pressure level in the spring biasing portion of the compensator to in turn develop a desired pressure level in the control piston of the vane pump and thus a desired setting of the cam ring of the pump. Output pressure level changes caused by changes in the load imposed upon the pump are reflected in altered pressure signals at the electro-hydraulic valve and the pressure compensator and are continuously modulated in the system to maintain a desired flow and pressure control for the system.

DETAILED DESCRIPTION OF THE DRAWINGS

DESCRIPTION OF THE PREFERRED EMBODIMENT

Figure 1:
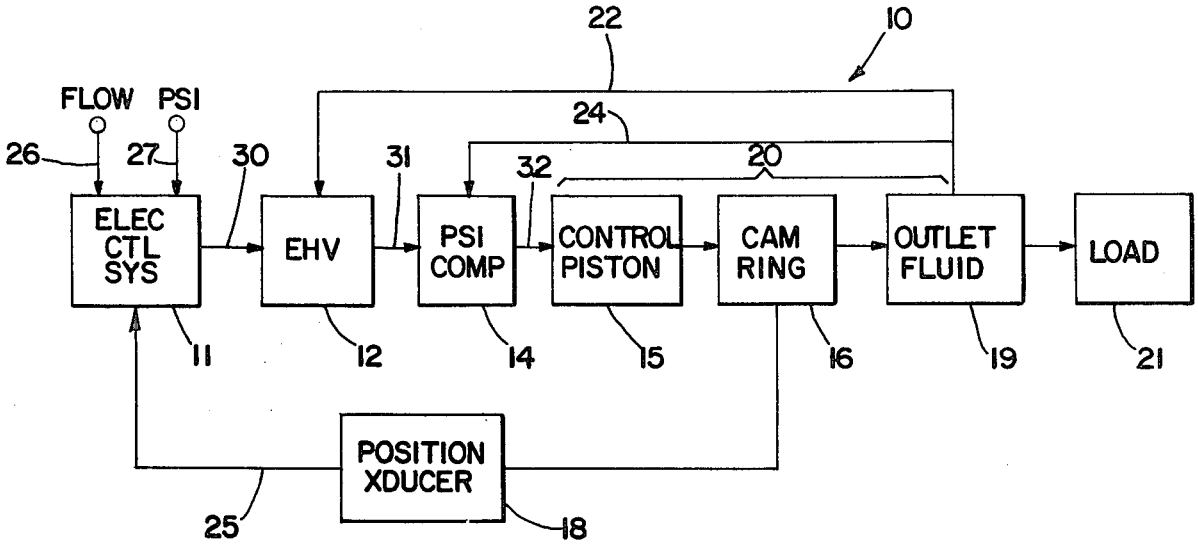
FIG. 1 is a schematic drawing in block diagram form of the combination of electrical control system and variable displacement pump of the invention showing the development of signals therein and the type of load compensation effected.

Referring now to the drawings in detail and initially to FIG. 1, the control system of the invention is indicated generally at 10 as including electronic control system 11, electro-hydraulic valve 12 (EHV), pressure compensator valve 14, control piston 15, cam ring 16, and position transducer 18. The control piston 15 and the cam ring 15 together with the box labeled outlet fluid 19 comprise the variable volume vane pump 20 which is the device for providing adjustable pressure and fluid flow to a load 21. The schematic showing of outlet fluid 19 is provided to indicate the effect that outlet fluid pressure has upon other components of the system, such fluid signal reflection being indicated by the feedback lines 22, 24 leading respectively to the EHV 12 and pressure compensator 14. Another feedback loop is provided including the position transducer 18 which develops an electrical signal on line 25 for application to the electrical control system 11, the signal on line 25 being indicative of the physical position of the cam ring 16 in the variable displacement pump 20. The control system is completed in the showing of FIG. 1 by the application of electrical command signals on lines 26, 27, indicative respectively of desired limits of flow and pressure.

In the preferred embodiment of the invention a variable volume vane pump is utilized, providing fluid under pressure for an injection molding machine for powering the die cylinder, injection cylinder and screw motor of the machine. In actual operation such machine mechanisms might be actuated singly or in various combinations and it is apparent that the great versatility afforded by the variable displacement type pump is particularly suited to such application. Although the variable displacement vane pump is described, it is apparent that other types of devices such as the variable displacement piston pump might be employed in combination with the control system. In fact, the system of the instant invention may be used in many applications where control of a common element is desired from a combination of electrical command signals as indicated herein.

In the variable displacement vane pump 20 of the preferred embodiment it is well-known that positioning of the cam ring 16 therein is determinative of the relative extension of vanes therein and thus is determinative of the outlet flow or displacement thereof and may be used as a device for controlling both pressure and flow levels of the pump. Reference may be had to Whitmore, et al U.S. Pat. No. 3,964,844 issued June 22, 1976 for a description of operation of such variable volume vane pump. In the axial piston-type pump a similar mode of operation is obtained by the positioning of the angle of the swash plate therein, the displacement and output flow thereof capable of similarly being monitored by a position transducer such as the one indicated at 18.

In the control system 10 depicted in FIG. 1, electrical signals applied at lines 25, 26, 27 result in the development of a control signal on line 30 which is applied to the electro-hydraulic valve 12. The valve 12 is a proportional device, and acting upon the outlet fluid 19 of the pump 20 received via line 22, provides an output pressure level on line 31 which is proportional to the fluid pressure on line 22 and the electrical control signal appearing on line 30. The pressure signal on line 31 then is applied to the pressure compensator 14 for control of the outlet fluid 19 from the pump 20.

As indicated, the variable volume vane pump 20 is a conventional pump having an adjustable cam ring 16 which is physically moved by a control piston 15 under the urging of fluid under pressure. In this instance the fluid pressure is supplied by the pressure compensator 14 to control the output of the pump 20. The pressure compensator 14 of this preferred embodiment is in part a conventional compensator acting in conjunction with the control piston 15 and cam ring 16 of the pump to provide a pressure compensated output thereof, for example in the manner described in the Schink, et al U.S. Pat. No. 3,549,281. In such state-of-the-art pressure compensators manual adjustment of the bias of the spring therein is made to control the force upon the spool of the valve which in turn develops fluid under pressure for application to the control piston 15 of the pump. This pressure is a function of the outlet pressure level which acts upon the spool of the valve in opposition to the spring force. Such typical system is depicted in FIG. 1 by the connection of line 24 from the outlet fluid stage 19 of the pump 20 to the pressure compensator 14 to develop an output signal therefrom on line 32 for application to the control piston 15 which in turn will position the cam ring 16.

Thus, for a given position of the cam ring 16 when the pump 20 is driven at constant speed by an electric motor or the like to provide a flow of outlet fluid to a load 21, a stabilized condition of the pump 20 and pressure compensator 14 will occur. Upon the occurrence of a change in load 21, for example by an increase in same, the pressure of the outlet fluid 19 will be increased and such increase will be reflected to the pressure compensator 14 by means of the feedback line 24. This results in a decreased level of fluid pressure occurring on line 32 applied to the control piston 15, thereby destroking the cam ring 16 to decrease the outlet flow of the pump. Such action results in tending to reduce the outlet fluid pressure level and will continue until a new stabilized position is achieved.

In this embodiment of the invention a modified pressure compensator 14 is employed for controlling the position of the cam ring 16 in the pump 20. Reference is made to the cross sectional showing of FIG. 2. The valve body 35 includes a lower bore 36 and upper bore 38 with connecting cross bores 39, 40, serving respectively as suction and system pressure ports, the latter receiving the outlet fluid pressure of the pump 20. A second suction port 41 communicates with the lower bore 36 as does a control piston bore 42, the latter being the connection for that line indicated at 32 in FIG. 1 for delivering fluid under pressure to the control piston 15. A large counter-bore 44 at one end of the body 35 constitutes a spring chamber which in turn communicates with the upper bore 38 by means of cross-bore 45. One end of the upper bore 38 is threaded at 46 to receive a fitting for connection to the EHV 12 as indicated by the line 31 in FIG. 1.

The lower bore 36 in the valve body 35 is closed at the left-hand end by threaded plug 48 and contains a valve spool 50 having lands 51–53 thereon which are in sealed sliding engagement with the valve body 35. There is a central bore in the sppol 50 extending part of its axial length, which provides communication by means of the cross-drilled holes 55 between the system pressure port 40 and the left-hand end of the spool 50 outside of the land 51. Thus it may be seen that system pressure applied at port 40 will act upon the lands 51, 53 and urge the spool 50 to the right as viewed in FIG. 2.

The valve spool 50 is urged to the left by means of compression spring 56 contained in the spring chamber 44 and acting through spring retainers against the right-hand end of the valve spool 50. The spring chamber 44 is closed at its right-hand end by means of the cap 58 to form a sealed chamber communicating only with the upper bore 38 by way of the cross bore 45. Pressure in chamber 44 acts against the right-hand end of spool 50 to develop force, which together with spring 56 force, urges the spool 50 to the left. Even with no pressure in chamber 44 the spring 56 urges the valve spool 50 to the left and to a position where land 52 uncovers the control piston bore 42 to allow the flow of system pressure from port 40 to the control piston port 42. It will be clear that when the valve spool 50 is moved to the right under the urging of system pressure, land 52 could be moved to a position to partially close port 42 thereby throttling system pressure to the control piston and if the spool 50 is moved still further to the right as viewed in FIG. 2, land 52 will completely close the path of communication between ports 40, 42 and open the path between control piston port 42 and suction port 39 whereby pressure in the control piston 15 may be delivered to the suction side of the fluid pump 20.

The left-hand end of the upper bore 38 is closed by means of spring loaded dart 60 having its downstream side located in the suction bore 39 to provide a relief valve function. The bias on the dart 60 may be adjusted by threading support rod 61 into the valve body 35. The compensator valve structure 14 is completed by the inclusion of an orifice 62 of reduced diameter positioned in the system pressure cross-bore 40 at the intersection of and communicating with the upper bore 38.

Figure 2:
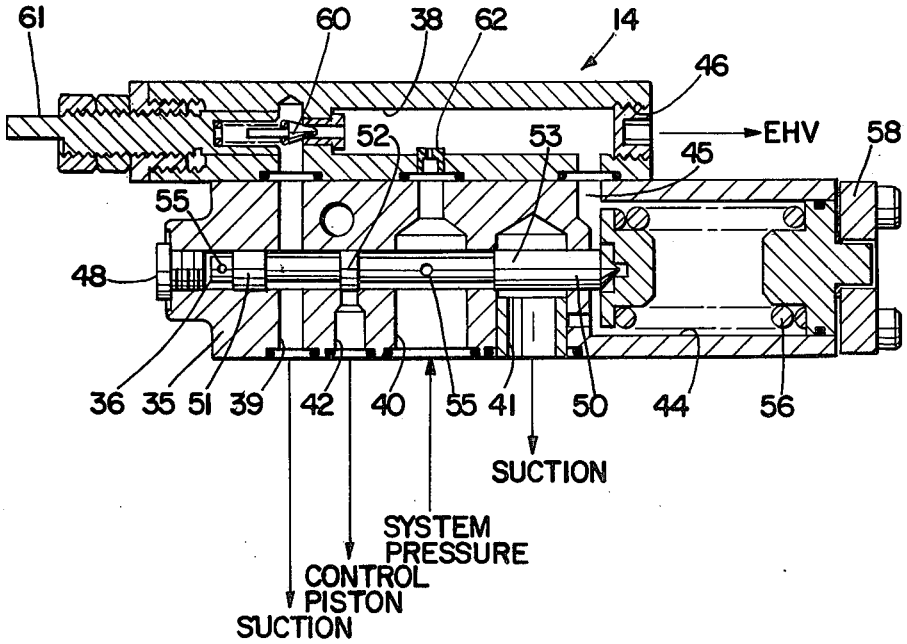
FIG. 2 is a side view in cross section of the pressure compensator valve of the invention.
Figure 4:
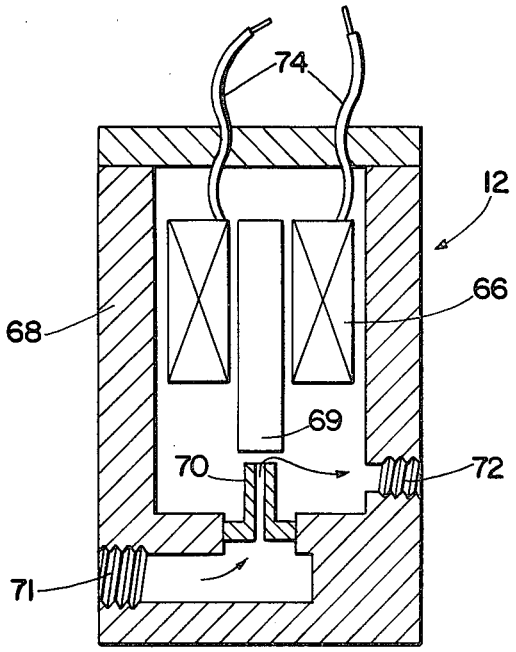
FIG. 4 is a side view in cross section of an electro-hydraulic valve suited for use in combination with the compensator valve of FIG. 2.

A typical electro-hydraulic valve suitable for connection to the threaded end 46 of the upper bore 38 of the compensator valve 14 of FIG. 2 is depicted in schematic form in the cross-sectional showing of FIG. 4. The valve 12 is a proportional pressure control valve providing an outlet pressure substantially proportional to the level of an input electrical current signal applied to the valve. In the preferred embodiment of the invention a model 82 proportional pressure control valve manufactured by the Fema Corporation of Portage, Mich., Part No. 8282C, is used. This valve is capable of providing an outlet pressure control over the range of up to approximately 2,000 psi at input current of up to approximately $\frac{1}{2}$ ampere. Flow variations of about 0.45 gpm at 250 psi to about 0.32 gpm at approximately 2,000 psi are provided by this valve. It will be clear, however, that this is but one type of valve which may be employed in systems of this kind and that many other similar types of valves may be utilized, within the teachings of this invention.

The EHV 12 comprises a torque motor coil 66 supported in a valve housing 68 for creating magnetic force against a longitudinally movable armature 69 co-axially supported therein. The armature 69 in turn serves to control the flow of fluid through a nozzle or valve seat 70 with which it cooperates, the valve seat routing fluid between inlet port 71 and outlet port 72. The inlet port 71 of the EHV 12 is connected to the threaded port 46 in upper bore 38 of the compensator valve 14, as indicated by the line 31 in FIG. 1 while the outlet port 72 is drained at atmospheric pressure back to tank. Thus as an electrical signal is applied to the energizing leads 74 of the torque motor coil 66, a magnetic field is created urging the armature 69 against the valve seat 70 in opposition to the flow of fluid therethrough, thereby restricting the orifice in the valve seat 70. Such restricted flow results in a back pressure being created in the inlet port 71 and thus in the upper bore 38 in the compensator valve 14.

In operation it may be seen that the compensator 14 acts to control pressure to the control piston port 42 as a function of the pump 20 outlet pressure which is applied at the system pressure port 40 and as a function of the pressure developed in the spring chamber 44 under control of the EHV 12. The pressure in upper bore 38 is derived from system pressure applied at port 40 less the pressure drop across orifice 62 which at typical operating levels is on the order of 200 psi. The pressure drop across orifice 62 is introduced to compensate for the force of spring 56 and effectively nullifies that force. Thus, the forces acting on spool 50 under typical operating conditions are substantially only a function of the system pressure applied at port 40 and that pressure within spring chamber 44, developed as a function of the EHV 12.

It may be seen, in this embodiment of the invention, that either pressure or flow control can be effected by controlling the pressure occurring in the spring chamber 44 to in turn develop the appropriate level of pressure at the control piston port 42 for application to the control piston 15 of the pump 20, thereby positioning the cam ring 16 for appropriate output displacement purposes. It may also be seen that such control may be effected remotely inasmuch as only an electrical signal is required at the input leads 74 to the EHV 12 to achieve either the flow or pressure control.

Figure 3:
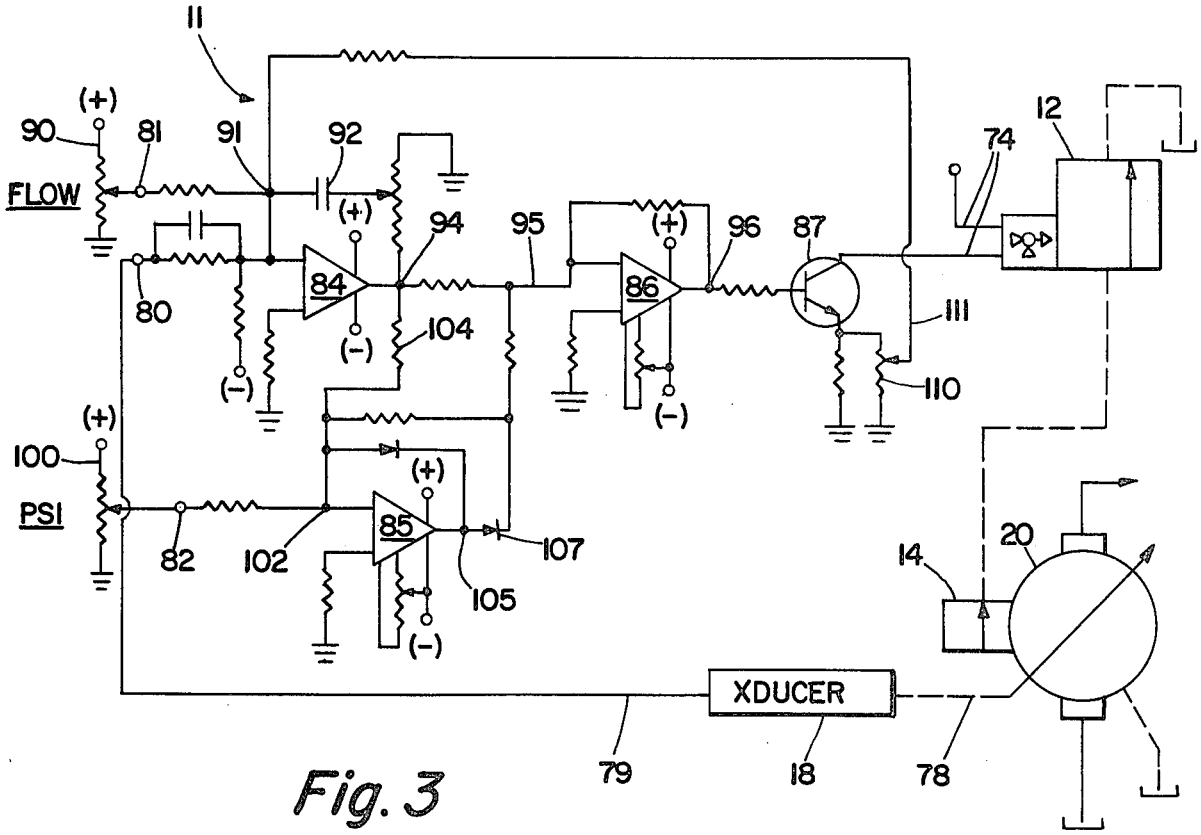
FIG. 3 is a schematic drawing in more detail of the electronic control portion of the system showing the interconnection with the electro-hydraulic valve and variable volume vane pump.

Referring now to the FIG. 3 schematic showing of the electrical portion of the system it will be seen that an electrical control signal is developed on the lines 74 for controlling the pressure level at the proportional pressure control valve 12, in turn affecting the pressure at the compensator valve portion 14 of the variable displacement vane pump 20 as previously described. The position transducer 18 is depicted as coupled to the variable displacement pump 20 by means of the dashed line 78. Such coupling is a physical engagement of the movable element of the position transducer 18 with the cam ring 16 of the pump 20 such that the transducer 18 provides an electrical signal at its output on line 79 which is proportional to the position of the cam ring 16 and thus the displacement of output flow of the pump 20. In the preferred embodiment of this invention the transducer 18 is a DCDT which is a direct current displacement transducer, this being a device which provides a direct current output signal as a function of the positioning of the movable element of the transducer. The feedback signal on line 79 is applied to terminal 80 of the electronic control system 11 as one of the inputs thereof. Command signal inputs are applied at the terminals 81, 82 representative respectively of flow and pressure levels for the pump 20.

The electrical control system 11 comprises integrated circuit operational amplifiers and a discreet power amplifier output stage, the first amplifier 84 being connected as an integrator circuit and the second and third amplifiers 85, 86 being connected as inverting summing amplifiers. Power output amplifier 87 is a power transistor connected in common emitter configuration. For purposes of this description the showing of the power supply for the electronic circuitry has been eliminated, however it will be understood that the amplifiers 84–87 are energized in a manner well-known in the art. In some instances voltage levels have been indicated at various terminals by the use of a plus or minus sign in parentheses, typically depicting a regulated source of supply voltage.

An input command signal representative of a desired level of flow is developed at the slider of potentiometer 90 and is applied by way of appropriate circuit components as one input to a summing junction 91, connected in turn as the inverting input to integrator amplifier 84. The feedback signal from transducer 18, applied at terminal 80 is similarly coupled to the summing junction 91 for combination with other signals thereat to provide the input to the integrator stage 84. Typically the command input signal at terminal 81 is a positive level signal in the range from 0 to 6 volts with a higher level signal indicating a higher desired level of flow for the variable displacement pump 20. The feedback signal applied at terminal 80 is a negative level signal also in the range of approximately 0 to −6 volts, being indicative of the position of the cam ring 16 in the pump 20, and arranged such that a greater negative level of voltage indicates a greater displacement or fluid flow for the pump 20. Integrator amplifier 84, having capacitor 92 in feedback connection therewith to provide the integrating function, serves to develop a voltage level at its output terminal 94 which changes at a rate proportional to the signal applied at its input, i.e., the summing junction 91. Integrator amplifier 84 is preferably a high quality device capable of maintaining a voltage level at output terminal 94 which is a function of the input voltage 91 and may be a Motorola integrated circuit type MC1456G or its equivalent, and as may the other operational amplifiers 85, 86. Power amplifier 87 may be transistor type 2N6045 or its equivalent.

The output of the integrator amplifier 84 is then applied to the inverting input 95 of a further operational amplifier 86 to develop a signal at output terminal 96 which is in turn applied to the base electrode of power output transistor 87. A control signal is thus developed on lines 74 for application to the EHV 12.

Thus it is seen that a closed loop position control system is effected for controlling the position of the cam ring 16 of the pump 20. Assuming the application of an input command signal representative of a desired level of flow at terminal 81 and thus at the summing junction 91, a voltage level will be developed at the output terminal 94 of the integrator stage 84 and by way of amplifiers 86, 87 applied to the EHV 12. This signal urges armature 69 of the EHV 12 to tend to close the valve orifice 70 and create an increased pressure level at the inlet port 71 thereof as well as in the upper bore 38 and the spring chamber 44 of the compensator valve 45. Referring further to FIG. 2, without any system pressure valve spring 56 would urge valve spool 50 to the left providing communication between pressure port 40 and control piston port 42 thereby providing communication to the control piston 15 for setting cam ring 16 to a position where greater flow output from the pump 20 could be produced. However, any build-up of system pressure in the pressure port 40 which would occur will act upon the lands 51, 53 to urge the spool 50 to the right, overcoming the relatively weak bias of the spring 56. Land 52 will close communication with the control piston port 42 and prevent further build-up of pressure in the control piston 15.

At such initial conditions described, the position transducer 18 will develop a relatively low voltage indicative of the relatively destroked position of the cam ring 16 of the pump 20. With such low feedback signal, a combined signal will result at the summing junction 91 to continue producing a further increase in the output level of the integrator amplifier 84, a greater control signal at output lines 74, and still further energization of the EHV 12. With further build-up in pressure in the spring chamber 44, the force acting on the right-hand area of the valve spool 50 will augment that of the spring 56 and urge the valve spool 50 to the left until land 52 uncovers the control piston port 42 to allow fluid flow to the control piston 15. Such increased pressure then will move the cam ring 16 to a further stroked position thereby increasing output flow of the pump. Such further movement of the cam ring 16 will be reflected as an increased negative voltage from position transducer 18. This sequence will continue until the signal from the transducer 18 is equal and opposite to that applied at the flow input 18 to result in a null voltage at the summing junction 91, thereby preventing further change in the output level of the integrator amplifier 84. The output voltage at terminal 94 will stabilize at this level thus providing a signal representative in amplitude of a desired position for the cam ring 16.

It will be seen that with the pump 20 operating at a desired compensated flow level afforded by a certain voltage at input terminal 81 any decrease in such voltage, as by adjusting the slider of potentiometer 90 downwardly to a lower voltage level, will effect a negative signal input at the summing junction 91 thereby altering the level at the output 94 of the integrator amplifier 84 in a manner opposite to that previously described, with such resultant lower signal level being applied to the input leads 74 of the EHV 12 to provide a lower fluid pressure output signal. Such lower pressure level will be reflected in the spring chamber 44 resulting in less force being applied to the valve spool 50 in the leftward direction such that the spool 50 will be urged to the right under the influence of system pressure. This action will cause land 52 on the spool to open the path of communication between the control piston port 42 and the suction port 39, thereby bleeding pressure from the control piston 15, causing a destroking movement of the cam ring 16. Again such action will continue until the output of the transducer 18 matches that at the input terminal 81 to produce a net zero signal at the summing junction 91 to stabilize the pressure level at the EHV 12.

Continuous control is provided as a function of the signal supplied at the flow command input terminal 81. Although this is depicted as being derived from a manually adjustable potentiometer 90, it might be derived in any other manner, for example, as the output of a computer control system for remote automatic control of the variable displacement pump 20 as a function of selected parameters.

Another feature of the invention is that a concurrent pressure limit of the variable displacement pump 20 can be effected by the combination of signals in the electronic control system 11. The pressure control limit command signal is applied at terminal 82, being derived from the slider of potentiometer 100. This voltage level typically ranges from zero to +6 volts, with the higher voltage level indicative of the higher level of pressure control limit for the pump 20. The pressure control signal from input terminal 82 is applied to a second summing junction 102 and is combined with the output of the integrator amplifier 84 by way of the connection of input resistor 104. A resultant signal thus is applied at the inverting input of the second operational amplifier 85 and a proportional output developed at output terminal 105.

The signal at the output terminal 105 is applied by way of a diode logic network consisting essentially of diodes 107, 108, to the input 95 of the second operational amplifier 86. The diode 107 is connected in a polarity to provide a clamping function upon the level of the signal appearing on the input terminal 95 such that the level of signal will not exceed the level of the pressure command signal at terminal 82. This prevents the control signal appearing on line 74 from exceeding a desired level, in turn preventing fluid pressure output from the EHV 12 greater than a commensurate level, thereby providing a pressure compensating function for the control system. It will be understood that such action will be operative in the flow control mode in that as the pump 20 is commanded to position the cam ring 16 for greater stroke and thus greater fluid outlet flow, such will be prevented beyond a preset level which is determined by the setting of the pressure compensating potentiometer 100.

To gain a better understanding of the operation of the electrical control system 11, representative signal levels are provided, these being indicative of one typical range of values which might be suitable for a system of this type. Command flow signals at terminal 81 are combined with feedback signals from terminal 80 at the summing junction 91. With a positive resultant signal at junction 91, output terminal 94 of the integrator amplifier 84 will increase in a negative sense.

Assume that a four volt signal is applied to the pressure input terminal 82, being derived from the potentiometer 100. This signal is applied to the summing junction 102 and combined with the signal at terminal 94. If at this time the output terminal 84 of the integrator amplifier 84 is at a zero volt level the resultant signal at input terminal 102 will be four volts and will produce a negative four volt signal at output terminal 105. Since the anode of diode 107 is more negative than the cathode terminal connected to the summing junction 95, no clamping will occur and the voltage at the junction 94 will be allowed to fluctuate.

However when the voltage at the output terminal 94 reaches a negative five volt level, such signal will be combined with the four volt signal at the pressure compensating terminal 82 to provide a resultant signal at summing junction 102 of negative one volt, producing in turn a positive one volt level at output terminal 105. Diode 107 is then forward biased allowing the positive one volt signal at 105 to be summed with the negative five volt signal at 104 for a net value of negative four volts at 95 (summing junction of operational amplifier 86). Therefore it will be seen that the output terminal of inverting amplifier 86 may not exceed the four volt level applied at terminal 82, thereby providing a pressure limiting level for control system 11.

An additional feature of the control system is the advantage that other compensation functions may be performed in the system by various techniques of handling electrical signals rather than by the use of complex valving devices and the like. For example, since it is known that the slip of a pump is related to the outlet pressure level of the pump a relatively easy compensation can be made for such slippage losses by the utilization of a signal in the system which is proportional to the outlet pressure level of the pump. In this instance since the control signals appearing on lines 74, as applied to the EHV 12, are related to the output pressure level of the pump 20 a portion of such signals may be fed back in an additive manner with the command input signal for the flow control level occurring on terminal 81 to provide a modified command signal. Such signal is obtained in the emitter circuit of the output transistor 87 being developed across potentiometer 110 and fed by way of the slider 111 to the summing junction 91 for combination with the command signal applied at terminal 81 and the feedback signal applied at terminal 80. While the slider of the potentiometer 110 is normally adjusted to a predetermined setting for automatic compensation for slip it may be re-adjusted from time to time to provide a greater or lesser proportion of compensating signal on line 111. This then allows a modification of the compensation for increased slip of the pump upon aging of the latter.

While in the preferred embodiment of the invention a modified form of compensator valve 14 is shown, it will be clear that the teachings of this invention are applicable in other embodiments, as well. Thus an electrohydraulic valve such as EHV 12 may be combined in different arrangements to control pressure levels in devices such as the control piston 15 of the variable displacement pump 20. The apparatus of the instant invention is preferred however in providing a more responsive and sensitive system.

We claim:

1. A control system for a variable displacement pump having a displacement controlling element moveable to various positions to vary pump output flow in response to urging of a fluid actuator, comprising a pressure compensator for developing a fluid pressure signal, said compensator being coupled to said fluid actuator as the sole element for control thereof, said compensator thereby being operative to control outlet fluid from said pump as a function of said fluid pressure signal, and electrical system means for modifying the fluid pressure signal developed in said compensator to provide both flow and pressure control of outlet fluid of said pump, said electrical system having flow and pressure command signals in electrical format and an electrohydraulic valve for controlling fluid pressure in said compensator, said electrohydraulic valve being responsive to a combination of flow and pressure command signals.

2. The system set forth in claim 1 wherein said modifying means comprises an electrical system having both flow and pressure command signals in electrical format.

3. The system set forth in claim 2 wherein said modifying means further comprises an electro-hydraulic valve for controlling pressure in said compensator, said electro-hydraulic valve being responsive to a combination of flow and pressure compensation electrical signals.

4. The system set forth in claim 1 wherein said modifying means further comprises means for developing an electrical feedback signal representative of the displacement controlling element of said variable displacement pump, said signal being combined with said flow and pressure command signals for control of said electrohydraulic valve.

5. The system set forth in claim 4 wherein said flow and feedback signals are electrically combined to provide a resultant signal for control of said electrohydraulic valve and said pressure signal provides a limiting level for said resultant signal.

6. The system set forth in claim 5 wherein said electro-hydraulic valve is a proportional pressure control valve.

7. A system for controlling outlet flow of a variable displacement pump pressure compensator fluid responsive device for adjustment of outlet flow, comprising input means having a flow command signal representative of a desired level of outlet flow of said pump, electrically operable means for controlling the delivery of fluid to said adjustment device and thus the position thereof in response to a control signal, means coupled to said adjustment device for providing a signal representative of the position thereof, and combining means for electrically combining said command and said position signals to provide said control signal.

8. The system set forth in claim 7 wherein said electrically operable means comprises an electrohydraulic valve.

9. The system of claim 8 wherein said position signal means comprises a differential transformer connected to said adjustment device of said pump.

10. The system set forth in claim 9 wherein said combining means comprises an integrator circuit responsive to said command and position signals for developing said control signal.

11. The system set forth in claim 10 further including means for developing a signal proportional to said control signal for application to said combining means as a correction for slippage of said pump.

12. The system set forth in claim 11 further including means for developing a pressure command signal for application to said combining means.

13. A compensator for a variable displacement pump having an adjustable flow controlling element therein, comprising a closed loop position control system for positioning said adjustable element in response to an electrical signal derived from an input command signal representative of a desired level of flow output and a feedback signal representative of actual flow output, and means for developing a pressure command level signal for application to said control system to limit said electrical signal therein, thereby providing flow and pressure control for said pump.

14. The compensator set forth in claim 13 wherein said closed loop system comprises fluid pressure means for positioning said adjustable element as a function of the level of fluid pressure therein.

15. The compensator set forth in claim 14 wherein said limiting means is coupled to said fluid pressure means to limit the level of fluid pressure, thereby providing a pressure compensation function.

16. The compensator set forth in claim 15 wherein said fluid pressure means comprises an electrohydraulic valve, a pressure compensator and a control piston wherein said limiting means is operable to limit the electrical signal applied to said electro-hydraulic valve.

17. A compensator system for a variable displacement pump, comprising fluid actuated means for positioning a displacement determinative element of said pump, a transducer coupled to said displacement element for providing a signal indicative of the position thereof, electrically operable means responsive to a control signal for controlling the application of fluid to said fluid actuated means, means for developing a first input command signal representative of a desired flow output of said pump, means combining said first command signal and said position signal to develop a resultant signal indicative of a desired position for said displacement element, and means for converting said resultant signal to a proportionate fluid pressure level for application to said fluid actuated means.

18. The system set forth in claim 17 further including means for developing a second input command signal representative of a desired level of pressure output of said pump, and means for preventing said resultant signal from exceeding said second command signal, thereby providing a pressure compensation level.

19. The system set forth in claim 18 wherein said converting means comprises electrically operable means for controlling fluid flow in response to said resultant signal.

20. The system set forth in claim 19 wherein said converting means further comprises a pressure compensator valve for said pump, said compensator being responsive to fluid flow from said electrically operable means.

21. The system set forth in claim 20 wherein said pump is a variable volume vane pump and said fluid actuated means is a control piston for positioning the cam ring of said pump.

22. The system set forth in claim 20 wherein said electrically operable means is an electro-hydraulic pressure valve.

23. The system set forth in claim 20 wherein said pressure compensator comprises a spool valve device for regulating pressure to said fluid actuated means as a function of the output pressure level of said pump.

24. The system set forth in claim 23 wherein said pressure compensator comprises means for biasing the spool in said spool valve as a function of the pressure signal from said electrically operable means.

25. The system set forth in claim 24 wherein said pressure compensator further comprises an orifice therein receiving fluid pressure from the outlet of said pump and communicating with a chamber for developing fluid pressure therein, said electrically operable means being operable to control the pressure in said chamber, said spool having one end exposed to pressure in said chamber for controlling the position of said spool.

26. The system set forth in claim 25 wherein outlet fluid pressure of said pump urges said spool in a direction opposite to force acting upon said one exposed end of said spool.

27. A pump, comprising flow generating means, fluid motor means for changing the flow rate of said flow generating means, means for adjusting the fluid pressure supplied to said fluid motor means, and means for generating a control signal for controlling said adjusting means, comprising means for producing a first command signal, means for producing a second command signal, means indicative of the position of said fluid motor means for producing a feedback signal, means responsive to said first command signal and said feedback signal for producing a first combined signal, means responsive to said first combined signal and said second command signal for producing a second combined signal, and means responsive to said first and second combined signals for producing said control signal.

28. A pump as set forth in claim 27 including means responsive to said control signal for modifying said first combined signal to compensate for internal leakage in said pump.

29. A pump as set forth in claim 27 wherein said first command signal is indicative of a predetermined outlet flow rate of said pump and said second command signal is indicative of a predetermined outlet pressure of said pump.

30. A pump as set forth in claim 27 wherein said means for producing a first combined signal is an integrating amplifier.

* * * * *

UNITED STATES PATENT AND TRADEMARK OFFICE

CERTIFICATE OF CORRECTION

PATENT NO. : 4,285,639

DATED : August 25, 1981

INVENTOR(S) : Richard H. Woodring, Paul K. Houtman, Thomas A. Kowalski and Charles H. Whitmore It is certified that error appears in the above-identified patent and that said Letters Patent are hereby corrected as shown below:

In column 11, line 53, add---which pump has a---after "displacement pump"

Signed and Sealed this

*Third* Day of *November 1981*

[SEAL]

*Attest:*

GERALD J. MOSSINGHOFF

*Attesting Officer*

*Commissioner of Patents and Trademarks*